United States Patent [19]

Dechelette et al.

[11] Patent Number: 4,807,358

[45] Date of Patent: Feb. 28, 1989

[54] CARRIER FOR MOLDED ARTICLES AND METHOD OF USING THE CARRIER

[75] Inventors: Helen Dechelette, Paris; Christian Fontenaud, Pontoise, both of France

[73] Assignee: Molex Incorporated, Lisle, Ill.

[21] Appl. No.: 74,647

[22] Filed: Jul. 17, 1987

[51] Int. Cl.[4] ..... H01Z 43/00

[52] U.S. Cl. ..... 29/857; 29/876; 29/881; 29/884; 29/759; 206/330

[58] Field of Search ..... 29/842, 854, 759, 884, 29/876, 881, 857, 747, 748; 206/330

[56] References Cited

U.S. PATENT DOCUMENTS

| | | | |
|---|---|---|---|
| 3,431,548 | 3/1969 | Busler . | |
| 4,149,768 | 4/1979 | Wise . | |
| 4,292,736 | 10/1981 | Hughes et al. | 29/884 |
| 4,541,174 | 9/1985 | Liburdi | 29/883 |
| 4,697,340 | 10/1987 | Finney et al. | 29/862 |

*Primary Examiner*—P. W. Echols
*Assistant Examiner*—Taylor J. Ross
*Attorney, Agent, or Firm*—John W. Cornell; Louis A. Hecht

[57] ABSTRACT

A reusable carrier for releasably retaining modular telephone jacks or other small molded articles is stamped and formed from a strip of metal and has a plurality of depending U-shaped clips extending from an elongated carrier strip. The carrier strip is generally flat with a series of pilot holes and struck out, downwardly bent locating projections positioned in between adjacent pilot holes. One of the U-shaped clips extends transversely from the carrier strip adjacent each of the pilot holes and is adapted to be releasably received within a plug receiving cavity of the jack. Each of the U-shaped clips includes a bight portion and opposed legs extending from the bight portion. Each of these legs has a pair of oppositely curved friction springs projecting outwardly from the leg so as to frictionally engage interior side walls of the plug receiving cavity when the jack is placed on the clip. A cantilevered spring latch is formed from the bight portion and includes a cam surface at its free end for releasably engaging a latch of the jack. The friction springs and the spring latch retain the jack on the clip and permit the removal of the jack from the clip upon the application of a withdrawal force on the jack. The carrier may be used in manufacturing, handling and/or installing jacks and other small articles and may be reused a number of times.

23 Claims, 3 Drawing Sheets

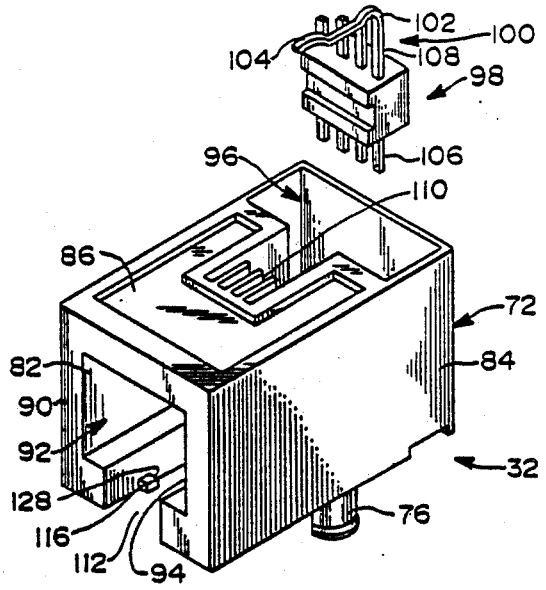
FIG.4
FIG.5
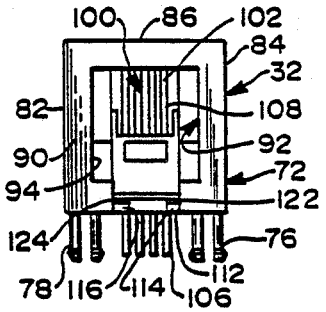
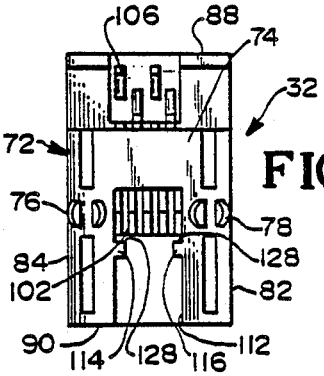
FIG.6
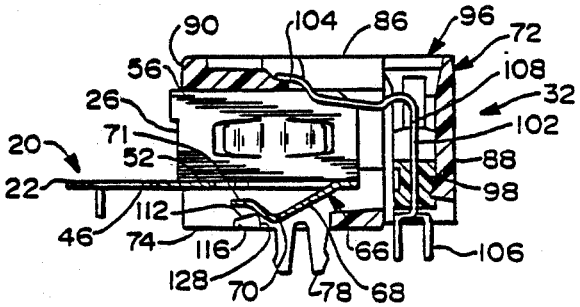
FIG.8

CARRIER FOR MOLDED ARTICLES AND METHOD OF USING THE CARRIER

BACKGROUND OF THE INVENTION

1. Field of the Invention

The present invention relates to a carrier for use with molded articles and more particularly, to a new and improved reusable carrier on which are releasably mounted small molded articles, such as modular telephone receptacles or jacks. The present invention also relates to the method of manufacturing, handling and/or installing small molded articles by utilizing a carrier on which such articles are releasably mounted so that the manufacturing, handling or installation of such articles may be automated and/or may be accomplished using robotics.

2. Description of the Prior Art

One type of small molded article is a modular electrical connector generally known as a modular telephone receptacle or jack. Modular jacks have been used in the telecommunications industry in interconnecting telephone components and as a wall receptacle to connect telephone equipment to telephone cables. These jacks also have been widely used for connecting telephone equipment to a telephone network or as an input/output (I/O) interface for communication peripheral equipment.

The modular jacks are adapted to receive a conventional modular plug. The plug is typically attached to an end of a cable containing a plurality of insulated conductors and may include contacts which pierce the insulation surrounding the conductors so as to couple each of the conductors to an individual contact. In order for the modular telephone jack to receive a modular plug, the jack is molded with a plug receiving opening at one end of a housing, which opening communicates into a plug receiving cavity formed in the housing.

In the case of what is known as a right angle modular telephone jack, the jack has its plug receiving opening at its front end and has opposed top and bottom walls joined by opposed side walls extending from the front end or plug receiving opening to a back or rear wall. A plurality of stamped, metallic elongated conductors are mounted in the housing. Each conductor includes a contact or spring contact portion at one end extending into the plug receiving cavity, a lead or tail portion at the other end normally extending out from the bottom wall of the modular jack housing and an intermediate portion interconnecting the contact and lead portions. The lead or tail portion may be designed so that when the bottom wall of the jack is mounted on a printed circuit board, the tail portion extends through holes in the printed circuit board such that the receptacle contacts are coupled to electrical circuits on the printed circuit board. When the plug is inserted in the plug receiving cavity of the receptacle housing, the plug contacts slidingly mate with the spring contact portions of the receptacle contacts such that the plug and receptacle form a interface between the conductors in the cable attached to the plug and the circuits on the printed circuit board.

It is advantageous to form the metallic conductors from a flat metal stock. In this manner, a plurality of conductors can be stamped at one time. Two examples of modular telephone jacks employing flat stamped metallic conductors are U.S. Pat. Nos. 4,292,736 and 4,315,644. Another patent disclosing the use of such contacts in modular telephone jacks is U.S. Pat. No. 4,618,207, which patent is assigned to the assignee of record of the present invention. In order to assemble the metallic conductors to the housing, the housing is transported to and positioned at a work station of an assembly machine. Thereafter, the assembled jacks are shipped to a user of such jacks. In the past, the shipment of the jacks was accomplished by placing the assembled jacks on a tray or into shipping tubes.

In U.S. Pat. No. 4,541,174, receptacle housings are maintained in proper spatial relationship to each other during the assembling of the conductors to the receptacle housing by plastic spacers interconnecting adjacent housings. After the conductors are installed in the housing, the spacers must be broken to separate the jacks into individual components. This procedure not only requires the spacers to be broken after the conductors are installed, but also requires groups of housings to be molded together so as to be joined by the spacers. In producing other types of products, integrally molded plastic strips are used to facilitate assembly operations. For example, U.S. Pat. Nos. 3,431,548 and 4,149,768 disclose molding housings to a plastic carrier strip.

As can be appreciated, the use of an integrally molded spacer, such as disclosed in U.S. Pat. No. 4,541,174, or the use of an integrally molded carrier strip, such as disclosed in U.S. Pat. Nos. 3,431,548 and 4,149,768, requires the spacer or carrier strip to be molded with the article and additionally, necessitates the breaking or severing of the spacer or carrier strip from the article before the article can be shipped or used. Moreover, since the spacer or carrier strip must be broken, the spacer or carrier strip cannot be reused and the article cannot be readily installed by robots.

SUMMARY OF THE INVENTION

Accordingly, objects of the present invention are to provide a new and improved carrier for use with small molded articles to facilitate the manufacturing, handling and robotic installation of the article; to provide a new and improved carrier which is reusable and adapted to be releasably received within a cavity of a small molded article; to provide a new and improved carrier having a generally U-shaped clip extending from a carrier strip with side friction springs and a spring latch to releasably retain the U-shaped clip in a cavity of a small molded article; to provide a new and improved carrier having a spring latch to releasably retain a small molded article on a clip portion of the carrier such that the article can be removed from the clip by supplying a force to the article; to provide a new and improved carrier for small molded articles produced from a metallic strip by means of a progressive stamping die; to provide a new and improved carrier having pilot holes for indexing or moving the carrier and struck out projections for positioning the carrier with respect to an assembly or installation work station; to provide a new and improved reusable carrier used in the assembly of modular telephone jacks, used in shipping such jacks to users of the jacks and used in installing such jacks on a printed circuit board by a robot or the like; and to provide a new and improved method of manufacturing, handling and installing molded articles by utilizing a single carrier which releasably retains the article on an elongated carrier strip.

In accordance with these and many other objects, an embodiment of the present invention comprises a carrier stamped from a metallic strip and having a plurality of depending clips extending from an elongated carrier strip so that modular telephone jacks may be releasably retained in proper spatial relationship. The carrier strip is a generally flat metallic part with a series of pilot holes for moving and indexing the carrier strip relative to a work station and struck out, downwardly bent locating projections extending at right angles from the plane of the carrier strip so that the carrier may be positively positioned relative to the work station. A generally U-shaped projection forming a depending clip extends from the carrier strip aligned with each of the pilot holes and is adapted to be releasably received within a housing cavity of a small molded article, such as a plug receiving cavity of a modular telephone jack. The U-shaped clip includes a bight or base portion attached to the carrier strip by a neckdown projection, the base extending transversely of and in the plane of the carrier strip. Opposed legs of the U-shaped clip form a pair of opposed upstanding side walls extending from the base or bight portion of the clip. Each of the side walls has a pair of oppositely curved friction springs projecting outwardly from the side wall so as to frictionally engage the side interior walls of the plug receiving cavity when the clip is inserted into the plug receiving cavity. The corners of the side walls of the clip remote from the carrier strip are beveled so that the clip may be more easily inserted into the plug receiving cavity.

In order to more positively secure the clip within the plug receiving cavity, a cantilevered spring latch arm is formed from the bight portion and includes a cam surface at its free end for releasably engaging a latch of the modular telephone jack. The cam surface enables the spring latch to not only engage the latch of the modular telephone jack when the clip is inserted into the plug receiving cavity, but also permits the disengagement of the spring latch from the jack latch upon application of a withdrawal force on the housing of the modular telephone jack. Consequently, the jack may be removed from the clip without the necessity of applying a force directly to the spring latch or destroying any portion of the carrier.

The present invention also includes a new and improved method of manufacturing, handling and/or installing modular telephone jacks by utilizing a carrier of the type heretofore described. In particular, the method includes the steps of mounting a modular telephone jack housing on the clip so that the jack housing is maintained on the clip due to the frictional engagement o the side friction springs with the interior side walls of the plug receiving cavity and the engagement of the spring latch with the latch of the modular telephone jack. The carrier is indexed by means of the pilot holes so that the modular telephone jack mounted on the clip is positioned at a work station in an assembly machine where contact modules may be installed into the modular telephone jack. Once the modular telephone jack has been fully assembled, a reel of modular telephone jacks may be formed from the carrier by winding the carrier strip into a reel. The reel of modular telephone jacks then may be shipped to a user of the jacks without the necessity of transferring the individual jacks onto trays or into shipping tubes. Upon receiving the reel of jacks, the user may utilize robots or the like to apply a withdrawal force to individual ones of the modular telephone jacks so as to remove the housing from the clip portions of the carrier and install individual modular telephone jacks on a printed circuit board or the like. Thereafter, the carrier strip may be reused for manufacturing of other modular telephone jacks because no portion of the carrier strip has been destroyed or altered either during the manufacturing, handling or installing of the modular telephone jacks.

DESCRIPTION OF THE DRAWING

Many other objects and advantages of the present invention will become apparent from the considering the following detailed description in conjunction with the drawings in which:

FIG. 4 is a perspective view of the modular telephone jack with which the carrier of FIG. 1 may be used shown with a contact module in position for insertion into the modular telephone jack housing;

FIG. 5 is a front view of the modular telephone jack shown in FIG. 4 with the contact module installed in the jack housing;

FIG. 6 is a bottom view of the modular telephone jack shown in FIG. 5;

FIG. 8 is a sectional view taken along line 7—7 of the FIG. 7;

DESCRIPTION OF THE PREFERRED EMBODIMENT

Figure 1:
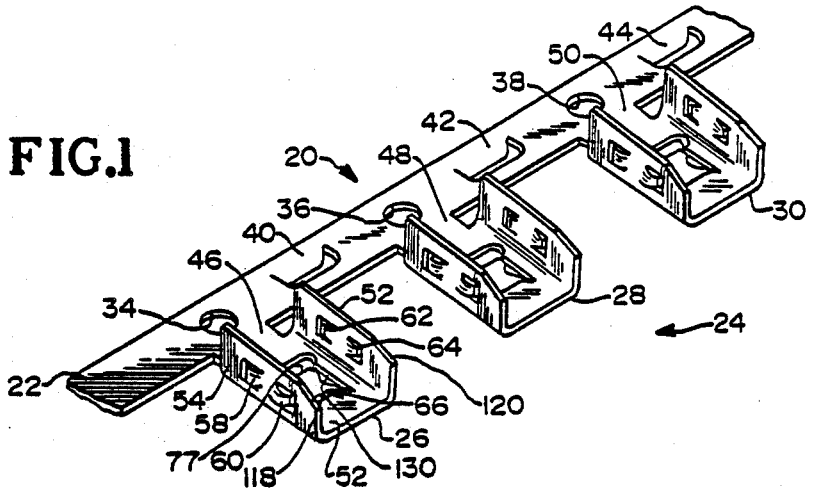
FIG. 1 is a perspective view of a portion of a carrier embodying the present invention.
Figure 2:
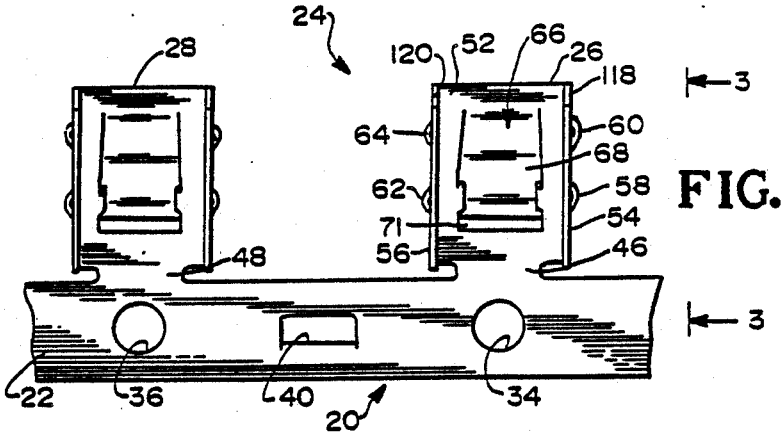
FIG. 2 is a top view of a portion of the carrier of FIG. 1 showing two of the clips extending from the carrier strip.
Figure 3:
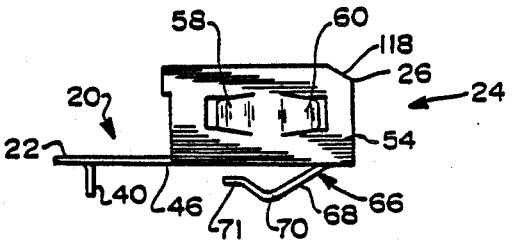
FIG. 3 is a side view of the carrier shown in FIG. 2 as viewed along line 3—3 of FIG. 2.

Referring now more specifically to FIG. 1 of the drawing, therein is disclosed a carrier which is generally designated by the numeral 20 and which embodies the present invention. The carrier consists of a carrier strip 22 and a plurality of generally U-shaped clips 24 extending transversely from the carrier strip 22. In FIG. 1, the carrier 20 is shown with clips 26, 28 and 30 extending from the carrier strip 22. The carrier strip 22 can be of a substantial length so that a substantial number of clips 24 may be included in the carrier 20. Each of the clips 24 is adapted to have mounted thereon a modular telephone jack, as for example, the modular telephone jack 32 shown in FIGS. 4–6.

The carrier 20 may be formed from a generally flat strip of metal in a progressive stamping die or the like. The carrier strip 22 so formed is a generally elongated, flat rectangular metallic part. A pilot hole is aligned on the carrier strip 22 along the central axis of each of the clips 24. In FIG. 1, pilot holes 34, 36 and 38 are so disposed adjacent to the clips 26, 28 and 30, respectively. The pilot holes 34, 36 and 38 are used in moving the carrier 20 relative to work stations or the like. The carrier strip 22 also has a plurality of downwardly bent locating projections, each of which is disposed midway between each of the pilot holes. In FIG. 1 of the drawing, three such projections 40, 42 and 44 are shown with the projection 40 being located midway between adjacent pilot holes 34 and 36 and the projection 42 being located midway between the next pair of adjacent pilot holes 36 and 38. The projections 40, 42 and 44 are used to positively position the carrier 20 at a work station or the like when the carrier 20 is used in assembling or installing modular telephone jacks 32.

Each of the clips 24 is joined to the carrier strip 22 by a neckdown attachment portion. In the case of clips 26, 28 and 30, the neckdown attachment portions 46, 48 and 50 join the clips 26, 28 and 30, respectively, to the carrier strip 22. As is illustrated in connection with the clip 26, the neckdown portion 46 extends transversely from the carrier strip 22 and is integrally formed with a base or bight portion 52 of the generally U-shaped clip 26. The remaining walls of the U-shaped clip 26, namely, opposed side walls or legs 54 and 56, are formed by bending the metal forming the clip 26 at a generally right angle to the plane of the bight portion 52.

The side wall 54 has a pair of curved, oppositely extending resilient projections or friction springs 58 and 60. Similarly, the side wall 56 has a pair of curved, oppositely extending resilient projections or friction springs 62 and 64. The springs 58, 60, 62 and 64 are used in retaining the modular telephone jack 32 on the clip 26. The modular telephone jack 32 also is retained on the clip 26 by a spring latch 66 extending downwardly from the bight portion 52 (see FIGS. 1–3 and 8). The spring latch 66 includes a cantilevered latch arm 68 having a cam surface 70 near its distal or free end 71. As will be described in more detail below, the spring latch 66 aids in retaining the modular telephone jack 32 on the clip 26, but allows the modular telephone jack 32 to be removed from the clip 26 whenever a withdrawal force is applied to the modular telephone jack 32.

Figure 10:
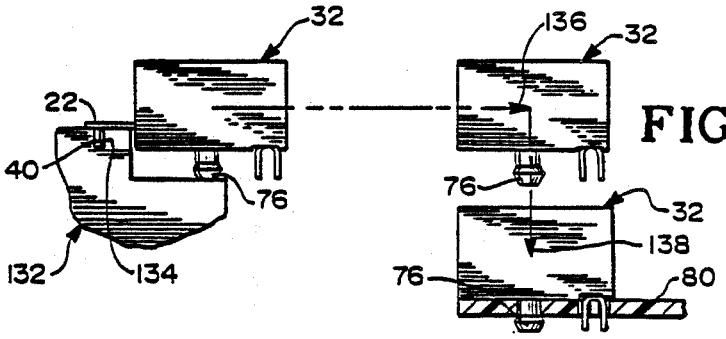
FIG. 10 is a schematic representation of how the carrier of FIG. 1 can be used to install a modular telephone jack of the type shown in FIGS. 4–6 on a printed circuit board.

As previously indicated, each of the clips 24 is adapted to receive a modular telephone jack like the modular telephone jack 32. Alternatively, any type of small molded article with an internal cavity may be mounted on the clips 24. As best seen in FIGS. 4–6, the modular telephone jack 32 includes a dielectric housing 72 with a bottom wall 74 having mounting posts 76 and 78 extending from the bottom wall 74. The mounting posts 76 and 78 are designed to extend through mating holes in a printed circuit board, such as a printed circuit board 80 shown in part in FIG. 10 of the drawing. When the mounting posts 76 and 78 are so positioned, the bottom wall 74 of the modular telephone jack 32 rests on the printed circuit board 80. Consequently, the jack 32 is sometimes referred to as a right angle jack. However, the carrier 20 may be used with other types of jacks, such as top entry or bottom entry jacks.

The jack 32 also has opposed side walls 82 and 84 extending upwardly from the bottom wall 74. A top wall 86, a rear wall 88 and a front or mating wall 90 form the other walls of the housing 72 and extend between the side walls 82 and 84. The walls 74, 82, 84, 86, 88 and 90 of the housing 72 form a plug receiving cavity 92, which is in communication with a plug receiving opening 94 formed in the front wall 90. The plug receiving cavity 92 is adapted to receive a modular telephone plug (not shown).

A slot 96 extends along the inside of the rear wall 88 through the top wall 86. The slot 96 is adapted to receive a contact module 98 (FIG. 4) having a plurality of contacts 100. As illustrated in connection with a contact 102, each of the contacts 100 have a spring contact portion 104 and a tail portion 106. An intermediate portion 108 interconnects the spring contact portion 104 to the tail portion 106 and is molded in the contact module 98. The contact module 98 is inserted into the slot 96 through the opening in the top wall 86. When the contact module 98 is properly positioned in the slot 96, the spring contacts 104 are disposed in locating slots 110 extending from the top wall 86 into the plug receiving cavity 92. Consequently, the spring contact portions, like the spring contact 104, extend diagonally into the plug receiving cavity 92 from the rear wall 88 (see FIG. 8) and slidingly mate with contacts of a modular telephone plug when the plug is inserted into the plug receiving cavity 92. On the other hand, the tail portions, such as the tail portion 106, extend downwardly from the bottom wall 74 so that they may be positioned in through holes in the printed circuit board 80 when the jack 32 is mounted on the printed circuit board 80 (see FIGS. 8 and 10).

The bottom wall 74 of the modular telephone jack 32 has a latch receiving slot 112 extending from the mating end 90. Opposed latch projections 114 and 116 extend into the slot 112 and are adapted to mate with a latch arm of a standard modular telephone plug when the plug is inserted into the plug receiving cavity 92. In addition, the latch projections 114 and 116 are adapted to mate with the spring latch 66 extending from the bight portion 52 of the clips 24 when a modular telephone jack, such as the modular telephone jack 32, is placed on one of the clips 24.

Figure 7:
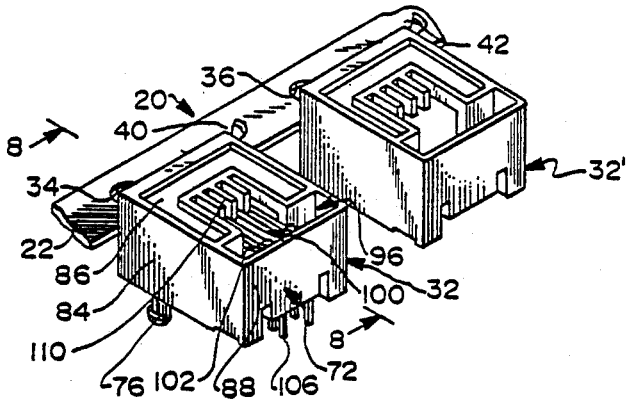
FIG. 7 is a carrier as shown in FIG. 1 with a modular telephone jack of FIG. 4 mounted on one of the clips prior to the insertion of the contact module and with another modular telephone jack on another of the clips after the contact module has been installed in the modular telephone jack housing.
Figure 9:
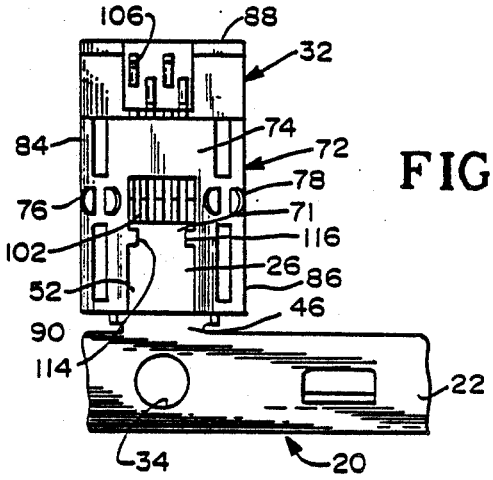
FIG. 9 is a bottom view of the assembled modular telephone jack of FIG. 7.

As illustrated in connection with the clip 28 in FIG. 7, a modular telephone jack 32′ may be positioned on one of the clips 24, such as the clip 28, prior to the contact module 98 being installed in the housing 72. In order to facilitate the mounting of the housing 72 on the clips 24, the ends of the side walls 54 and 56 are beveled to form inclined or beveled surfaces 118 and 120. Once housings like the housing 72 are positioned on the clips 24, the carrier strip 22 is moved relative to work stations in an assembly machine (not shown) by means of a sprocket or the like engaging the pilot holes 34, 36 and 38. When the housing 72 is positioned at a particular work station, the contact module 98 is inserted into the slot 96. The clip 28 is small enough to allow sufficient clearance between the clip 28 and the rear wall 88 of the jack 32′ so that the clip 28 does not extend into the slot 96 and interfer with the insertion of the contact module 98. After the contact module 98 is so positioned in the slot 96, the carrier strip 22 again is advanced so that another contact module 98 may be installed in another housing 72 to form another assembled modular telephone jack 32.

The modular telephone jack 32′ must be securely mounted on the clip 28 while the contact module 98 is being inserted into the slot 96 and later the modular telephone jacks 32 must remain securely mounted on the clips 24 during handling and/or shipping of the carrier 20. In order to maintain the jacks 32 on the clips 24 and as can be best seen in FIG. 8 of the drawing with reference to the modular telephone jack 32 positioned on the clip 26, the width of the clip 26 between the legs 54 and 56 is slightly less than the distance between the interior surfaces of the side walls 82 and 84 so that the springs 58 and 60 frictionally engage or bear against the inner surface of the side wall 84 and the friction springs 62 and 64 frictionally engage or bear against the inner surface of the side wall 82. In addition, as the modular telephone jack 32 is placed on the clip 26, the latch arm 68 will slide along an inclined or a cam surface 122 on the latch projection 114 and an inclined or a cam surface 124 on the latch projection 116. When the modular telephone jack 32 is fully inserted onto the clip 26, the cam surface 70 near the distal end 71 of the latch arm 68 becomes lodged against the rearward surfaces 126 and 128 of the latch projection 114 and 116, respectively (see FIG. 8). As a result, the latch 66 latches the modular telephone jack 32 on the clip 26. However, the jack 32 can be removed from the clip 26 without the necessity of applying any force directly to the latch 66. When a withdrawing force is applied to the housing 72, the latch 66 will resiliently flex toward the bight portion 52 such that the cam surface 70 will become disengaged from the surfaces 126 and 128 and will slide over the projections 114 and 116 permitting the removal of the modular telephone jack 32 from the clip 26. As a result, robots or the like can be used to remove the housing 72 from the clip 26 even though the latch 66 is not readily accessible from the outside of the housing 72, as for example in the case of a housing that does not have a latch receiving slot 112 extending through the bottom wall 74.

In order to prevent the latch arm 68 from overflexing into an opening 130 resulting in the base 52 when the latch 66 is formed, the distal end 71 of the latch arm 68 is enlarged (FIGS. 1–2) so that the enlarged end 71 will engage the base 52 of the clip 26 prior to the remainder of the latch arm 68 becoming lodged in the opening 130. This insures that the latch 66 can be operated, i.e., flexed, a number of times without being overstressed and weakened. Consequently, the carrier 20 can be reused a number of times.

After the modular telephone jacks 32 are fully assembled on the carrier 20, the carrier strip 22 may be wound into a reel so that a large quantity of such modular telephone jacks 32 may be maintained on the carrier 20 and shipped to a user of the modular telephone jacks 32. Advantageously, the same carrier 20 that is used in assembling the modular telephone jacks 32 may be used when the modular telephone jacks 32 are shipped to a user of the jacks 32.

The same carrier 20 with the modular telephone jacks 32 thereon may be utilized in the installing of the modular telephone jacks 32 on a printed circuit board, such as the printed circuit board 80. More specifically and with reference to FIG. 10 of the drawing, therein is disclosed one possible use of the carrier 20 in connection with the installation of the modular telephone jacks 32 onto the printed circuit board 80. The carrier 20 is positioned on a device 132 with the locating projections, such as the locating projection 40, disposed in a locating slot 134. This insures that modular telephone jacks 32 on the carrier 20 are properly positioned both in the direction along the carrier strip 22 and in the transverse direction with respect to a robot or the like (not shown) which is used in the installation of the modular telephone jack 32. Once properly positioned at a work station, a robot or the like may apply a force in the direction of an arrow 136 in FIG. 10. When such a force is applied to the modular telephone jack 32, the telephone jack 32 becomes dislodged from the carrier 20 and is positioned above the printed circuit board 80. Thereafter, the robot or the like may move the modular telephone jack 32 in a direction of an arrow 138 in FIG. 10. As a result, the telephone jack 32 is properly positioned on the printed circuit board 80 with the mounting posts 76 and 78 and the tail portions 106 of the contacts 102 extending through the printed circuit board 80.

Consequently, the same carrier 20 that is used in assembling the jack 32 may be used for not only shipping the jacks 32 to a user, but also for installing the jack on a printed circuit board or the like. Moreover, since the carrier 20 is not deformed in any manner during any one of these operations, the carrier 20 may be reused for assembling, shipping or installing additional telephone jacks 32.

The telephone jack 32 disclosed in FIGS. 4, 6-10 is a modular telephone jack containing four contacts 100. Similar types of telephone jacks may be mounted on the carrier 20 which modular telephone jacks are capable of mounting different numbers of contacts 100. For example, a telephone jack may contain six or eight contacts like the contact 100. In order to mount the larger number of contacts in the telephone jack, the width of the plug receiving cavity 92 is increased. In such an event, the width of the clips 24 have to be matched to the jack 32 by correspondingly increasing the distance between the side walls 54 and 56 so that the friction springs 58 and 60 make contact against the inner side wall 84 of the housing and the friction springs 62 and 64 make contact with the inner side wall 82 of the housing 72. However, in such instances, the distance between adjacent pilot holes is maintained constant even though the width of the individual clips 24 is changed.

While the telephone jacks 32 disclosed in the drawings are designed to be mounted on the printed circuit board 80 by having the tail portions 106 of the contacts 100 extend through holes in the printed circuit board 80, the carrier 20 can be used with other types of modular telephone jacks. For example, the lead or tail portions 106 of the contacts 100 may be electrically connected to a wire either by crimping or insulation displacement or the tail portions 106 may be designed so that the telephone jacks 32 are mounted on the printed circuit board 80 by surface mount technology. In addition, the carrier 20 can be used in manufacturing and/or installing any other type of small molded article that has an internal cavity.

While the invention has been described with reference to details of the illustrated embodiment, it should be understood that such details are not intended to limit the scope of the present invention as defined in the appended claims.

What is claimed and desired to be secured by Letters Patent of the United States is:

1. A carrier for releasably retaining a plurality of electrical connectors, each electrical connector including a housing having an interior cavity with interior walls, said carrier comprising:

an elongated carrier strip, a plurality of clips extending from said carrier strip, each of said clips including a plurality of walls, and engaging means extending from said walls of said clip to releasably engage said interior walls when one of said electrical connectors is placed on one of said clips.

2. The carrier as set forth in claim 1 wherein said engaging means includes frictional spring means on at least one of said walls of said clip to bear against at least one of said interior walls of said interior cavity.

3. The carrier as set forth in claim 2 wherein said spring means includes oppositely extending curved spring projections extending outwardly from at least one of said walls of said clip.

4. The carrier as set forth in claim 1 wherein each of said electrical connectors includes a latch and wherein said engaging means includes a latch means formed from one of said walls of said clip, said latch means adapted to releasably engage said latch.

5. The carrier as set forth in claim 4 wherein said walls of said clip include a base portion and a pair of walls extending from said base portion and wherein said latch means includes a cantilevered arm formed from said base portion with a cam surface formed on the free end of said cantilevered arm adapted to engage said latch, said free end of said cantilevered arm being wider than the remaining portion of said cantilevered arm.

6. The carrier as set forth in claim 5 wherein said free end of said cantilevered arm engages said base portion as said cantilevered arm is flexed toward said base portion.

7. The carrier as set forth in claim 1 wherein said carrier strip includes a pilot hole located adjacent each of said clips and includes a locating projection extending from said carrier strip midway between each of said pilot holes.

8. The carrier as set forth in claim 1 wherein said carrier strip is a stamped and formed generally flat metal strip capable of being wound into a reel.

9. The carrier as set forth in claim 1 wherein each of said clips is connected to said carrier strip by a neck-down connecting portion.

10. The carrier as set forth in claim 1 wherein said walls of said clip include a base portion and a pair of walls extending transversely from said base portion to form opposed upstanding walls, wherein the interior walls of said electrical connector include at least a pair of opposed side walls and wherein the distance between said opposed side walls is slightly greater than the distance between said opposed upstanding walls of said clip.

11. The carrier as set forth in claim 10 wherein said base portion and said pair of walls of said clip form a generally U-shaped clip.

12. A carrier for carrying a plurality of electrical connectors having an interior cavity with a pair of opposed side walls and a latch associated with another wall of said cavity, said carrier comprising:

an elongated carrier strip, at least one U-shaped clip extending transversely from said carrier strip, said clip having a bight portion in the plane of said carrier strip and a pair of legs extending from said bight portion, friction springs projecting from each of said legs, said friction springs bearing against said opposed side walls when said clip is positioned in said cavity, and a cantilevered latch arm extending outwardly from said bight portion, said latch arm having a cam surface near its free end to releasably engage said latch of said electrical connector when said clip is positioned in said cavity.

13. The carrier as set forth in claim 12 wherein said latch of said electrical connector includes a latch projection and wherein said cam surface of said latch arm engages said latch projection to maintain said clip in said cavity of said electrical connector.

14. The carrier as set forth in claim 12 wherein said latch of said electrical connector has an inclined surface upon which said cam surface of said latch arm slides as said clip is being positioned in said cavity.

15. The carrier as set forth in claim 12 wherein said free end of said latch arm flexes toward said bight portion upon a withdrawal force being applied to said electrical connector away from said carrier strip.

16. A metallic carrier for carrying a plurality of modular connectors, each of said connectors having a receiving cavity formed of at least opposed inside side walls and having a connector latch, said carrier comprising:

a generally flat elongated carrier strip, said carrier strip having indexing and locating means, at least one U-shaped clip extending transversely from said carrier strip from an edge thereof, said clip having a bight portion and a pair of legs extending from said bight portion, a pair of oppositely extending friction springs projecting from each of said legs, said friction springs bearing against said inside side walls when said clip is positioned in said receiving cavity, and a cantilevered clip latch formed from and extending outwardly from said bight portion, said clip latch having a free end adapted to releasably engage said connector latch.

17. The carrier as set forth in claim 16 wherein said connector latch includes a latch projection having an inclined surface, wherein said connector has a connecting wall interconnecting said opposed side walls, said connecting wall having a slot into which said latch projection extends and wherein said free end of said clip latch has a cam surface which slides on said inclined surface of said latch projection as said clip is positioned in said receiving cavity.

18. A method of using a carrier with a plurality of electrical connectors, each of said electrical connectors having an interior cavity, said method comprising the steps of:

placing an electrical connector on at least some of a plurality of clips extending from a carrier strip portion of said carrier and retaining said electrical connector on said clip by means of engaging means extending from said clip and releasably engaging interior walls of said interior cavity of said electrical connector, moving said carrier strip portion relative to a work station so as to position said electrical connector at said work station for assembling components into said electrical connector, positioning said carrier relative to a device for installing said electrical connector, and removing said electrical connector from said clip so as to install said electrical connector by applying a withdrawal force to said electrical connector.

19. The method as set forth in claim 18 wherein said electrical connector is retained on said clip by spring means extending from said clip frictionally engaging the interior walls of said electrical connector.

20. The method as set forth in claim 18 wherein said electrical connector is retained on said clip by a latch arm extending from said clip releasably engaging a latch on said electrical connector.

21. The method as set forth in claim 18 including the step of winding the carrier strip portion into a reel prior to positioning said carrier relative to said device for installing said electrical connector.

22. The method as set forth in claim 18 wherein said carrier strip portion is moved relative to said work station by means of indexing holes located on said carrier strip portion adjacent to each of said clips.

23. The method as set forth in claim 18 wherein said carrier is positioned relative to said device for installing said electrical connector by positioning means extending from said carrier strip portion.

* * * * *